US006037314A

United States Patent [19]

Kondo et al.

[11] Patent Number: 6,037,314

[45] **Date of Patent: *Mar. 14, 2000**

[54] GREASE COMPOSITION FOR CONSTANT VELOCITY JOINTS

[75] Inventors: Shinya Kondo; Junichi Imai; Takashi Okaniwa, all of Fujisawa; Kenji Ueno, Toyota; Hitoshi Ishii, Chita; Fumio Ueda, Aichi-ken, all of Japan

[73] Assignees: Kyodo Yushi Co., Ltd., Tokyo; Toyota Jidosha Kabushiki Kaisha, Toyota, both of Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/869,774

[22] Filed: Jun. 5, 1997

[30] Foreign Application Priority Data

Jun. 7, 1996 [JP] Japan ..... 8-145704

[51] Int. Cl.[7] ..... C10M 43/28

[52] U.S. Cl. ..... 508/363; 508/321; 508/379; 508/390; 508/391; 460/525; 460/552; 460/586

[58] Field of Search ..... 508/168, 391, 508/460, 444, 552, 363

[56] References Cited

U.S. PATENT DOCUMENTS

| | | |
|---|---|---|
| 3,840,463 | 10/1974 | Froeschmann et al. . |
| 4,536,308 | 8/1985 | Pehler et al. . |
| 4,759,859 | 7/1988 | Waynick . |
| 4,787,992 | 11/1988 | Waynick . |
| 4,830,767 | 5/1989 | Waynick . |
| 4,840,740 | 6/1989 | Sato et al. . |
| 4,902,435 | 2/1990 | Waynick . |
| 5,126,062 | 6/1992 | Barnes . |
| 5,160,645 | 11/1992 | Okaniwa et al. . |
| 5,207,936 | 5/1993 | Anzai et al. . |
| 5,449,471 | 9/1995 | Ozaki et al. . |
| 5,589,444 | 12/1996 | Hatakeyama . |
| 5,604,187 | 2/1997 | Takeuchi et al. . |
| 5,607,906 | 3/1997 | Okaniwa et al. ..... 508/168 |
| 5,607,907 | 3/1997 | Watanabe et al. . |

FOREIGN PATENT DOCUMENTS

| | | |
|---|---|---|
| 0 508 115 | 10/1992 | European Pat. Off. . |
| 62 207397 | 9/1987 | Japan . |
| WO 94/11470 | 5/1994 | WIPO . |
| WO 96/02615 | 2/1996 | WIPO . |

*Primary Examiner*—Margaret Medley
*Attorney, Agent, or Firm*—Oblon, Spivak, McClelland, Maier & Neustadt, P.C.

[57] ABSTRACT

A grease composition for constant velocity joints comprises (a) a base oil; (b) a urea thickener; (c) at least one organic molybdenum compound selected from the group consisting of molybdenum dithiocarbamate and molybdenum dithiophosphate; and (d) at least one calcium salt selected from the group consisting of calcium salts of petroleum sulfonates, calcium salts of alkyl aryl sulfonates, calcium salts of salicylate, calcium salts of phenates, calcium salts of oxidized waxes, overbasic calcium salts of petroleum sulfonates, overbasic calcium salts of alkyl aryl sulfonates, overbasic calcium salts of salicylate, overbasic calcium salts of phenates, and overbasic calcium salts of oxidized waxes. The grease composition exhibits good performance for reducing vibration and effectively lubricates the constant velocity joints to effectively reduce frictional wear and to eliminate vibration.

7 Claims, No Drawings

GREASE COMPOSITION FOR CONSTANT VELOCITY JOINTS

BACKGROUND OF THE INVENTION

The present invention relates to a grease composition for use in constant velocity joints. A very high contact pressure is developed between the parts of the constant velocity joints to be lubricated and the joint parts undergo complicated rolling motions. This often results in abnormal vibration. Accordingly, the present invention relates to a grease composition for constant velocity joints, which can effectively lubricate such constant velocity joints to effectively reduce the wear of joints and to effectively reduce the occurrence of the vibration.

Examples of lubricating greases conventionally used in such constant velocity joints include a calcium complex soap thickened grease, and a lithium soap thickened grease, e.g., a grease containing sulfur-phosphorus extreme pressure agent selected from the group consisting of fats and oils sulfide, tricresylphosphate and zinc dithiophosphate.

Recently, the number of front engine drive (FF-type) motorcars have rapidly increased for ensuring light weight and making interior space as large as possible. Constant velocity joints (CVJ) essential for these motorcars are widely used. Among the CVJs, plunging constant velocity joints, in particular, tripod type constant velocity joints (TJ) and double offset type constant velocity joints (DOJ) cause complicated rolling and sliding motions during rotation under conditions at an angle and accordingly, causes slide resistance in the axial direction, which causes vibration during tick over, rolling in starting and speeding up, and beating and/or confined noise in a car at a given speed. To solve these problems, various improvement have been made for the structure of constant velocity joints. However, it is difficult to make such improvement in the light of the space occupied by the joint, weight and cost thereof, and there is a need for a grease which has good performance for reducing vibration.

SUMMARY OF THE INVENTION

Accordingly, an object of the present invention is to provide a novel grease composition for constant velocity joints which has good performance for reducing vibration.

Another object of the present invention is to provide a grease composition for plunging type constant velocity joints which effectively lubricates the constant velocity joints to effectively reduce frictional wear and to eliminate vibration.

The inventors of this invention have conducted various studies to develop a grease composition capable of reducing the frictional wear of the constant velocity joints and of eliminating the vibration. The inventors have carried out a quality evaluation of greases used under lubricating conditions under which vibration is easily occurred, using an SRV (Schwingung Reibung und Verschleiss) tester known as an oscillating friction and wear tester, to determine lubricating characteristics. As a result, the inventors have found that there is a special relationship between vibration caused by a constant velocity joint and a frictional coefficient determined under a specific vibration condition using the SRV tester. Further, the inventors have studied the above relationship for urea grease compositions containing various extreme pressure agents. As a result, they have found that a grease composition comprising a base oil, a urea thickener, organic molybdenum, and a specific calcium salt, and a grease composition further containing a specific sulfur-phosphorus extreme pressure agent exhibit desired lubricating characteristics such as a low friction coefficient and have confirmed, by a forced test performed using a practical constant velocity joint, that the grease can prevent the occurrence of vibration, unlike the conventional greases for constant velocity joints and thus have completed the present invention.

The foregoing object of the present invention can effectively be accomplished by providing a grease composition for constant velocity joints which comprises:

(a) a base oil;

(b) a urea thickener;

(c) at least one organic molybdenum compound selected from the group consisting of molybdenum dithiocarbamate and molybdenum dithiophosphate; and (d) at least one calcium salt selected from the group consisting of calcium salts of petroleum sulfonates, calcium salts of alkyl aryl sulfonates, calcium salts of salicylate, calcium salts of phenates, calcium salts of oxidized waxes, overbasic calcium salts of petroleum sulfonates, overbasic calcium salts of alkyl aryl sulfonates, overbasic calcium salts of salicylate, overbasic calcium salts of phenates, and overbasic calcium salts of oxidized waxes.

According to the preferred embodiment of the present invention, the grease composition comprises, in addition to the components (a) to (d), the component (e): a sulfur-phosphorus extreme pressure agent of one or more of the members selected from the group consisting of fats and oils sulfides, polysulfides, phosphates, phosphites, thiophosphates, and zinc dithiophosphates.

DESCRIPTION OF THE PREFERRED EMBODIMENTS

The present invention will hereunder be explained in more detail.

The base oil as Component (a) is not restricted to specific ones and may be, for instance, lubricating oils currently used such as mineral oils, ether type synthetic oils, hydrocarbon type synthetic oils or mixture thereof.

The urea thickener as Component (b) is not restricted to specific ones and may be, for instance, diurea compounds and polyurea compounds.

Examples of the diurea compounds include those obtained through a reaction of a monoamine with a diisocyanate compound. Examples of the diisocyanates include phenylene diisocyanate, diphenyl diisocyanate, phenyl diisocyanate, diphenylmethane diisocyanate, octadecane diisocyanate, decane diisocyanate, and hexane diisocyanate. Examples of the monoamines include octylamine, dodecylamine, hexadecylamine, octadecylamine, oleylamine, aniline, p-toluidine, and cyclohexylamine.

Examples of the polyurea compounds include those obtained through a reaction of a monoamine or a diamine with a diisocyanate compound. Examples of the diisocyanates and the monoamines include those used for the formation of the diurea compounds as mentioned above. Examples of the diamines include ethylenediamine, propanediamine, butanediamine, hexanediamine, octanediamine, phenylenediamine, tolylenediamine, and xylenediamine.

Preferred examples of urea thickeners include those obtained through a reaction of aliphatic amine such as octylamine and stearylamine, cyclohexyl amine or a mixture thereof with a diisocyanate.

Molybdenum dithiocarbamates can be used as Component (c). Preferred examples of the molybdenum dithiocarbamates may be represented by the formula (1):

$$(R^1R^2N—CS—S)_2—Mo_2OmSn \quad (1)$$

wherein $R^1$and $R^2$ represent independently alkyl groups having 1 to 24 carbon atoms, preferably 3 to 18 carbon atoms, m is 0 to 3, n is 4 to 1 and m+n is 4.

Molybdenum dithiophosphates can be used as Component (c). Preferred examples of the molybdenum dithiophosphates may be represented by the formula (2):

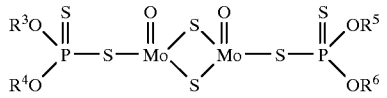

(2)

wherein $R^3$, $R^4$, $R^5$ and $R^6$ represent independently primary or secondary alkyl groups having 1 to 24 carbon atoms, preferably 3 to 20 carbon atom s, or aryl groups having 6 to 30 carbon atoms, preferably 8 to 18 carbon atoms.

The calcium salts as Component (d) are selected from those known as metal detergent dispersants or rust-inhibitors which are used in lubricants such as engine oils, such as calcium salts of oxidized waxes, calcium salts of petroleum sulfonates which are obtained by the sulfonation of aromatic hydrocarbon in lubricating oil fraction, calcium salts of alkyl aryl sulfonates such as salts of dinonylnaphthalene sulfonic acid and alkylbenzene sulfonic acid, calcium salts of salicylate, calcium salts of phenates, overbasic calcium salts of oxidized waxes, overbasic calcium salts of petroleum sulfonates, overbasic calcium salts of alkyl aryl sulfonates, overbasic calcium salts of salicylate, and overbasic calcium salts of phenates.

Particularly preferred are calcium salts of petroleum sulfonates, calcium salts of dinonylnaphthalene sulfonic acid and calcium salts of alkyl aryl sulfonic acid.

Fats and oils sulfides can be used as Component (e) of the invention. Preferred examples of the fats and oils sulfides include those obtained by adding sulfur to animal or plant fats and oils having unsaturated bonds such as olive oil, castor oil, tea seed oil, rice bran oil, cottonseed oil, rapeseed oil, soybean oil, corn oil, tallow, beaf foot oil, sperm oil, and spermaceti, and heating the mixture.

Polysulfides can be used as Component (e). Preferred examples of the polysulfides include polysulfides of the formula (3) and olefin sulfides wherein 2 to 5 sulfur atoms are bonded in the molecule.

$$R^7—Sc—R^8 \quad (3)$$

wherein $R^7$ and $R^8$ may be same or different and represent alkyl groups having 4 to 22 carbon atoms, aryl groups having 6 to 22 carbon atoms, alkylaryl groups having 7 to 22 carbon atoms, or arylalkyl groups having 7 to 22 carbon atoms, and c is an integer of 2 to 5.

Particularly preferred are dibenzyl disulfide, di-tert-dodecyl polysulfide and di-tert-nonyl polysulfide.

Further, there may be used as Component (e), phosphates of the formula (4), phosphites of the formula (5), thiophosphates of the formula (6) and zinc dithiophosphates of the formula (7).

$$(R^9O)(R^{10}O)P(=O)(OR^{11}) \quad (4)$$

$$(R^9O)(R^{10}O)P(OR^{11}) \quad (5)$$

$$(R^9O)(R^{10}O)P(=S)(OR^{11}) \quad (6)$$

$$[(R^9O)(R^{12}O)P(=S)—S]_2—Zn \quad (7)$$

wherein $R^9$ and $R^{12}$ represent independently alkyl groups having 1 to 24 carbon atoms, cycloalkyl groups having 6 to 24 carbon atoms, alkylcycloalkyl groups having 8 to 24 carbon atoms, aryl groups having 6 to 24 carbon atoms, alkylaryl groups having 7 to 24 carbon atoms, or arylalkyl groups having 7 to 24 carbon atoms, $R^{10}$ and $R^{11}$ represent independently hydrogen atoms, alkyl groups having 1 to 24 carbon atoms, cycloalkyl groups having 7 to 24 carbon atoms, alkylcycloalkyl groups having 8 to 24 carbon atoms, aryl groups having 6 to 24 carbon atoms, alkylaryl groups having 7 to 24 carbon atoms, or arylalkyl groups having 7 to 24 carbon atoms.

Particularly preferred are phosphates such as tricresyl phosphate, dibutyl phosphate, and dioctyl phosphate; phosphites such as tristearyl phosphite, tridecyl phosphite, and triphenyl phosphite; thiophosphates of the formula (6) wherein $R^9$, $R^{10}$ and $R^{11}$ are alkyl groups having 12 or 13 carbon atoms, that is, trialkyl thiophosphates and alkylated triphenyl thiophosphate; zinc dithiophosphate of the formula (7) wherein $R^9$ and $R^{12}$ are primary or secondary alkyl groups having 3 to 20 carbon atoms and aryl groups having 8 to 18 carbon atoms.

Component (e) of the present invention is sulfur-phosphorus extreme pressure agent. Accordingly, thiophosphates and zinc dithiophosphates may be used alone, but fats and oils sulfides containing only sulfur, or phosphates and phosphites containing only phosphorus must be used in combination.

The grease composition for constant velocity joints of the present invention may contain antioxidants, rust inhibitors and corrosion inhibitors in addition to the foregoing essential components.

The grease composition for constant velocity joints of the present invention preferably contain based on the total weight of the composition, 50.0 to 98.4% by weight of Component (a) a base oil; 1 to 25% by weight of Component (b) an urea thickener; 0.1 to 10% by weight of Component (c) an organic molybdenum compound; and 0.5 to 15% by weight of Component (d) a calcium salt.

The grease composition for constant velocity joints of the present invention more preferably contain based on the total weight of the composition 40.0 to 98.3% by weight of Component (a) a base oil; 1 to 25% by weight of Component (b) a urea thickener; 0.1 to 10% by weight of Component(c) an organic molybdenum compound; 0.5 to 15% by weight of Component (d) a calcium salt; and 0.1 to 10% by weight of Component (e) a sulfur-phosphorus extreme pressure agent.

The grease composition for constant velocity joints of the present invention more preferably contain based on the total weight of the composition, 60.0 to 95.0% by weight of Component (a) a base oil; 3 to 20% by weight of Component (b) a urea thickener; 0.5 to 5% by weight of Component(c) an organic molybdenum compound; 1 to 10% by weight of Component (d) a calcium salt; and 0.5 to 10% by weight of Component (e) a sulfur-phosphorus extreme pressure agent.

If the amount of Component (b) is less than 1% by weight, the thickening effect thereof tends to become too low to convert the composition into a grease, while if it exceeds 25% by weight, the resulting composition tends to become too hard to ensure the desired effects of the present invention. Moreover, it becomes difficult to obtain the desired effects of the present invention if the amount of Component (c) is less than 0.1% by weight, the amount of Component (d) is less than 0.5% by weight, or the amount of Component (e) is less than 0.1% by weight. On the other hand, if the amount of Component (c) is more than 10% by weight, the amount of Component (d) is more than 15% by weight, or the amount of Component (e) is more than 10% by weight, any further improvement in the effects cannot be expected.

The present invention will hereunder be described in more detail with reference to the following non-limitative working Examples and Comparative Examples.

EXAMPLES 1 to 10, 13 to 15 AND COMPARATIVE EXAMPLES 1 to 6

There were added, to a container, 460 g of a base oil and 38.7 g of diphenylmethane-4,4'-diisocyanate and the mixture was heated to a temperature between 70 and 80° C. To another container, there were added 460 g of a base oil, 24.6 g of cyclohexylamine and 16.7 g of stearylamine followed by heating at a temperature between 70 and 80° C. and addition thereof to the foregoing container. The mixture was then reacted for 30 minutes with sufficient stirring, the temperature of the reaction system was raised up to 170° C. with stirring and the reaction system was allowed to cool to give a base urea grease. To the base grease, there were added the following additives listed in Table 1 in amounts likewise listed in Table 1 and an optional and additional amount of the base oil and the penetration of the resulting mixture was adjusted to the No. 1 grade by a three-stage roll mill.

EXAMPLE 11

There were added, to a container, 440 g of a base oil and 58.9 g of diphenylmethane-4,4'-diisocyanate and the mixture was heated to a temperature between 70 and 80° C. To another container, there were added 440 g of a base oil and 61.1 g of octylamine followed by heating at a temperature between 70 and 80° C. and addition thereof to the above mentioned container. The mixture was then reacted for 30 minutes with sufficient stirring, the temperature of the reaction system was raised up to 160° C. with stirring and the reaction system was allowed to cool to give a base urea grease. To the base grease, there were added the following additives listed in Table 1 in amounts likewise listed in Table 1 and an optional and additional amount of the base oil and the penetration of the resulting mixture was adjusted to the No. 1 grade by a three-stage roll mill.

EXAMPLE 12

There were added, to a container, 425 g of a base oil and 68.0 g of diphenylmethane-4,4'-diisocyanate and the mixture was heated to a temperature between 70 and 80° C. To another container, there were added 425 g of a base oil, 73.8 g of stearylamine and 8.2 g of ethylenediamine followed by heating at a temperature between 70 and 80° C. and addition thereof to the foregoing container. The mixture was then reacted for 30 minutes with sufficient stirring, the temperature of the reaction system was raised up to 160° C. with stirring and the reaction system was allowed to cool to give a base urea grease. To the base grease, there were added the following additives listed in Table 1 in amounts likewise listed in Table 1 and an optional and additional amount of the base oil and the penetration of the resulting mixture was adjusted to the No. 1 grade by a three-stage roll mill.

In all of the above mentioned Examples and Comparative Examples, a mineral oil having the following properties was used as the base oil.

Viscosity: at 40° C. 91.4 $mm^2/s$
at 100° C. 10.5 $mm^2/s$

Viscosity Index: 97

Moreover, a commercially available lithium grease containing sulfur and phosphorus extreme pressure agents was used as the grease of Comparative Example 7.

Physical properties of these greases were evaluated according to the methods detailed below. The results thus obtained are also summarized in Table 1.

[Penetration] According to ISO 2137

[Dropping point] According to ISO 2176

[SRV Test]

Test Piece:

ball: diameter 17.5 mm (SUJ-2)

cylindrical plate: diameter 24 mm×thickness 7.85 mm (SUJ-2)

Conditions for Evaluation:

Load: 200 N

Frequency: 20 Hz

Amplitude: 0.4 mm

Time: 2 min

Test Temperature: 40° C.

Items evaluated: Maximum coefficient of friction

[Axial force Test]

The greases were inspected, under the following conditions, for the axial force of real joints.

Test Conditions:

Number of Revolutions: 200 rpm

Torque: 400 N·m

Angle of Joint: 8°

Operation Time: 5 minutes

Type of Joint Used: Tripod Joint

Item evaluated: Increase or decrease of the axial force taking the commercially available lithium grease as standard The results of Examples and Comparative Examples of Table 1 show that the grease compositions of the present invention have remarkable effects of reduction of friction coefficient and elimination of vibration, since the grease compositions comprise (a) a base oil; (b) a urea thickener; (c) at least one organic molybdenum compound selected from the group consisting of molybdenum dithiocarbamate and molybdenum dithiophosphate; and (d) at least one calcium salt selected from the group consisting of calcium salts of petroleum sulfonates, calcium salts of alkyl aryl sulfonates, calcium salts of salicylate, calcium salts of phenates, calcium salts of oxidized waxes, overbasic calcium salts of petroleum sulfonates, overbasic calcium salts of alkyl aryl sulfonates, overbasic calcium salts of salicylate, overbasic calcium salts of phenates, and overbasic calcium salts of oxidized waxes; and optionally (e) a sulfur-phosphorus extreme pressure agent of one or more of the members selected from the group consisting of fats and oils sulfides, polysulfides, phosphates, phosphites, thiophosphates, and zinc dithiophosphates.

TABLE 1

| | Example | | | | | |
|---|---|---|---|---|---|---|
| Components | 1 | 2 | 3 | 4 | 5 | 6 |
| 1) Diurea Grease ① | 92.0 | 92.0 | 92.0 | 92.0 | 92.0 | 92.0 |
| 2) Diurea Grease ② | — | — | — | — | — | — |
| 3) Polyurea Grease | — | — | — | — | — | — |
| 4) Molybdenum dithiocarbamate① | 3.0 | 3.0 | 3.0 | 3.0 | 3.0 | 3.0 |
| 5) Molybdenum dithiocarbamate② | — | — | — | — | — | — |
| 6) Molybdenum dithiocarbamate③ | — | — | — | — | — | — |
| 7) Calcium sulfonate ① | 5.0 | — | — | — | — | — |
| 8) Calcium sulfonate ② | — | 5.0 | — | — | — | — |
| 9) Calcium petroleum sulfonate | — | — | 5.0 | — | — | — |
| 10) Calcium salicylate | — | — | — | 5.0 | — | — |
| 11) Calcium phenate | — | — | — | — | 5.0 | — |

TABLE 1-continued

| | | | | | | |
|---|---|---|---|---|---|---|
| 12) Overbasic calcium sulfonate | — | — | — | — | — | 5.0 |
| 13) Thiophosphate (ester) | — | — | — | — | — | — |
| 14) Zinc dithiophosphate | — | — | — | — | — | — |
| 15) Penetration (60 W) | 323 | 319 | 320 | 328 | 325 | 317 |
| 16) Dropping Point (° C.) | 243 | 242 | 239 | 242 | 238 | 240 |
| 17) SRV Test Friction coefficient | 0.07 | 0.07 | 0.07 | 0.07 | 0.08 | 0.07 |
| 18) Axial force test | −32 | −32 | −30 | −28 | −29 | −27 |

| | Example | | | | |
|---|---|---|---|---|---|
| Components | 7 | 8 | 9 | 10 | 11 |
| 1) Diurea Grease (1) | 91.5 | 91.5 | 91.5 | 91.5 | — |
| 2) Diurea Grease (2) | — | — | — | — | 91.5 |
| 3) Polyurea Grease | | | | | |
| 4) Molybdenum dithiocarbamate(1) | 3.0 | — | — | 3.0 | 3.0 |
| 5) Molybdenum dithiocarbamate(2) | — | 3.0 | — | — | — |
| 6) Molybdenum dithiocarbamate(3) | — | — | 3.0 | — | — |
| 7) Calcium sulfonate (1) | — | — | — | — | — |
| 8) Calcium sulfonate (2) | 5.0 | 5.0 | 5.0 | 5.0 | 5.0 |
| 9) Calcium petroleum sulfonate | — | — | — | — | — |
| 10) Calcium salicylate | — | — | — | — | — |
| 11) Calcium phenate | — | — | — | — | — |
| 12) Overbasic calcium sulfonate | — | — | — | — | — |
| 13) Thiophosphate (ester) | 0.5 | 0.5 | 0.5 | — | 0.5 |
| 14) Zinc dithiophosphate | — | — | — | 0.5 | — |
| 15) Penetration (60 W) | 321 | 319 | 320 | 321 | 325 |
| 16) Dropping Point (° C.) | 239 | 242 | 239 | 239 | 241 |
| 17) SRV Test Friction coefficient | 0.06 | 0.05 | 0.06 | 0.05 | 0.06 |
| 18) Axial force test | −41 | −36 | −38 | −38 | −30 |

| | Example | | | |
|---|---|---|---|---|
| Components | 12 | 13 | 14 | 15 |
| 1) Diurea Grease (1) | — | 90.5 | 94.5 | 85.5 |
| 2) Diurea Grease (2) | — | — | — | — |
| 3) polyurea Grease | 91.5 | — | — | — |
| 4) Molybdenum dithiocarbamate(1) | 3.0 | 2.0 | 2.0 | 2.0 |
| 5) Molybdenum dithiocarbamate(2) | — | 2.0 | 2.0 | 2.0 |
| 6) Molybdenum dithiocarbamate(3) | — | — | — | — |
| 7) Calcium sulfonate (1) | — | — | — | — |
| 8) Calcium sulfonate (2) | 5.0 | 5.0 | 1.0 | 10.0 |
| 9) Calcium petroleum sulfonate | — | — | — | — |
| 10) Calcium salicylate | — | — | — | — |
| 11) Calcium phenate | — | — | — | — |
| 12) Overbasic calcium sulfonate | — | — | — | — |
| 13) Thiophosphate (ester) | 0.5 | 0.5 | 0.5 | 0.5 |
| 14) Zinc dithiophosphate | | | | |
| 15) Penetration (60 W) | 324 | 322 | 319 | 328 |
| 16) Dropping point (° C.) | 242 | 239 | 238 | 240 |
| 17) SRV Test Friction coefficient | 0.07 | 0.05 | 0.06 | 0.05 |
| 18) Axial force test | −31 | −43 | −40 | −45 |

| | Comparative Example | | | |
|---|---|---|---|---|
| Components | 1 | 2 | 3 | 4 |
| 1) Diurea Grease (1) | 97.0 | 97.0 | 97.0 | 95.0 |
| 2) Diurea Grease (2) | — | — | — | — |
| 3) Polyurea Grease | — | — | — | — |
| 4) Molybdenum dithiocarbamate(1) | 3.0 | — | — | — |
| 5) Molybdenum dithiocarbamate(2) | — | 3.0 | — | — |
| 6) Molybdenum dithiocarbamate(3) | — | — | 3.0 | — |
| 7) Calcium sulfonate (1) | — | — | — | — |
| 8) Calcium sulfonate (2) | — | — | — | 5.0 |
| 9) Calcium petroleum sulfonate | — | — | — | — |
| 10) Calcium salicylate | — | — | — | — |
| 11) Calcium phenate | — | — | — | — |
| 12) Overbasic calcium sulfonate | — | — | — | — |
| 13) Thiophosphate (ester) | — | — | — | — |
| 14) Zinc dithiophosphate | — | — | — | — |
| 15) Penetration (60 W) | 318 | 322 | 327 | 319 |
| 16) Dropping Point (° C.) | 240 | 243 | 238 | 241 |
| 17) SRV Test Friction coefficient | 0.10 | 0.09 | 0.10 | 0.12 |
| 18) Axial force test | −7 | −5 | −2 | +10 |

TABLE 1-continued

| | Comparative Example | | |
|---|---|---|---|
| Components | 5 | 6 | 7* |
| 1) Diurea Grease (1) | 99.5 | 99.5 | |
| 2) Diurea Grease (2) | — | — | |
| 3) Polyurea Grease | — | — | |
| 4) Molybdenum dithiocarbamate(1) | — | — | |
| 5) Molybdenum dithiocarbamate(2) | — | — | |
| 6) Molybdenum dithiocarbamate(3) | — | — | |
| 7) Calcium sulfonate (1) | — | — | |
| 8) Calcium sulfonate (2) | — | — | |
| 9) Calcium petroleum sulfonate | — | — | |
| 10) Calcium salicylate | — | — | |
| 11) Calcium phenate | — | — | |
| 12) Overbasic calcium sulfonate | — | — | |
| 13) Thiophosphate (ester) | 0.5 | — | |
| 14) Zinc dithiophosphate | — | 0.5 | |
| 15) Penetration (60 W) | 318 | 328 | 280 |
| 16) Dropping Point (° C.) | 239 | 240 | 190 |
| 17) SRV Test Friction coefficient | 0.09 | 0.09 | 0.12 |
| 18) Axial force test | +7 | +2 | standard |

1) Diurea grease using a diurea compound wherein cyclohexyl amine and stearylamine are used as a monoamine
2) Diurea grease using a diurea compound wherein octyl amine is used as a monoamine
3) Polyurea grease using a polyurea compound wherein stearyl amine is used as a monoamine and ethylenediamine is used as a diamine
4) Molybdenum dithiocarbamate (available from R. T. Vanderbilt Company under the trade name of Molyvan A)
5) Molybdenum dithiocarbamate (available from R. T. Vanderbilt Company under the trade name of Molyvan 822)
6) Molybdenum dithiophosphate (available from Asahi Denka K.K. under the trade name of SAKURA-LUBE 300)
7) Calcium alkylaryl sulfonate (available from Alox Corporation under the trade name of Alox 2292B)
8) Calcium dinonylnaphthalenesulfonate (available from King Industries under the trade name of NA-SUL 729)
9) Calcium petroleum sulfonate (available from Matsumura Petroleum Laboratory Co., Ltd. under the trade name of Sulfol Ca-45)
10) Calcium salicylate (available from Osca Chemical Co., Ltd. under the trade name of OSCA 423)
11) Calcium phenate (available from Oronite Japan Co., Ltd. under the trade name of OLOA 218A)
12) Overbasic calcium sulfonate (available from Witco Corporation under the trade name of Bryton C-400C)
13) Thiophosphate (ester) (available from CIBA-GEIGY under the trade name of Irgalube 211)
14) Zinc dithiophosphate (available from Lubrizol Japan under the trade name of Lubrizol 1360)
15) Penetration according to ISO 2137 at 60 W
16) Dropping point according to ISO 2176 (° C.)
17) SRV test: friction coefficient
18) Axial force test
(*) Commercially available grease containing sulfur and phosphorus extreme pressure agents

What is claimed is:

1. A grease composition for constant velocity joints which consist essentially of:

(a) a base oil;

(b) a urea thickener;

(c) at least one organic molybdenum compound selected from the group consisting of molybdenum dithiocarbamate and molvbdenum dithiophosphate;

(d) at least one calcium salt selected from the group consisting of calcium salts of petroleum sulfonates, calcium salts of alkyl aryl sulfonates, calcium salts of salicylate, calcium salts of phenates, calcium salts of oxidized waxes, overbasic calcium salts of petroleum sulfonates, overbasic calcium salts of alkyl aryl sulfonates, overbasic calcium salts of salicylate, overbasic calcium salts of phenates, and overbasic calcium salts of oxidized waxes; and (e) thiophosphates.

2. The grease composition for constant velocity joints of claim 1 wherein based on the total weight of the composition, 1 to 25% by weight of the urea thickener; 0.1 to 10% by weight of the organic molybdenum compound; 0.5 to 15% by weight of the calcium salt and 0.1 to 10% by weight of the thiophosphate extreme pressure agent are present in the said composition.

3. The grease composition for constant velocity joints of claim 1 wherein based on the total weight of the composition, 3 to 20% by weight of the urea thickener; 0.5 to 5% by weight of the organic molybdenum compound; 1 to 10% by weight of the calcium salt and 0.5 to 10% by weight of the thiophosphate extreme pressure agent are present in the said composition.

4. The grease composition for constant velocity joints of claim 1 wherein said constant velocity joints are constant velocity plunging joints.

5. The grease composition for constant velocity joints of claim 1 wherein the urea thickener is a diurea compound.

6. The grease composition for constant velosity joints of claim 2 wherein the urea thickner is a diurea compound.

7. The grease composition for constant velocity joints of claim 1 wherein said composition further consist essentially of at least one member selected from the group consisting of antioxidants, rust inhibitors and corrosion inhibitors.

* * * * *